US007772780B2

(12) United States Patent
Pokharna et al.

(10) Patent No.: US 7,772,780 B2
(45) Date of Patent: Aug. 10, 2010

(54) LAMP IGNITER MODULE AND TRANSFORMER CARRIER

(75) Inventors: Rajendra K. Pokharna, Ellicott City, MD (US); David J. Kachmarik, Strongsville, OH (US); Virgil Chichernea, Mentor, OH (US); Bruce Roberts, Mentor on the Lake, OH (US); David A. D'Onofrio, Cleveland, OH (US)

(73) Assignee: General Electric Company, Schenectady, NY (US)

( * ) Notice: Subject to any disclaimer, the term of this patent is extended or adjusted under 35 U.S.C. 154(b) by 688 days.

(21) Appl. No.: 11/646,213

(22) Filed: Dec. 27, 2006

(65) Prior Publication Data

US 2008/0157696 A1 Jul. 3, 2008

(51) Int. Cl.
*H01J 7/44* (2006.01)

(52) U.S. Cl. ..... 315/56; 315/57; 315/82; 362/265

(58) Field of Classification Search ..... 315/32, 315/51, 57, 70, 82; 362/263, 265, 507; 313/318.01, 313/318.03, 318.04; 307/10.8
See application file for complete search history.

(56) References Cited

U.S. PATENT DOCUMENTS

| | | | | |
|---|---|---|---|---|
| 6,181,081 | B1 | 1/2001 | Hirschmann et al. | |
| 6,429,591 | B1 * | 8/2002 | Takamatsu et al. | 315/56 |
| 6,731,076 | B1 | 5/2004 | Gerhard et al. | |
| 6,867,673 | B2 * | 3/2005 | Minami et al. | 336/107 |
| 2004/0066150 | A1 | 4/2004 | Neumeier et al. | |
| 2006/0055340 | A1 | 3/2006 | Burkhardt et al. | |

OTHER PUBLICATIONS

Colonel Wm. T. McLyman; "Transformer and Inductor Design Handbook"; Second Edition Revised and Expanded; Copyright 1988, pp. 35-45, by Marcel Dekker, Inc., New York, New York.

* cited by examiner

*Primary Examiner*—Douglas W Owens
*Assistant Examiner*—Ephrem Alemu
(74) *Attorney, Agent, or Firm*—Fay Sharpe LLP

(57) ABSTRACT

Disclosed are a lamp igniter module and method of assembling a lamp igniter module. The lamp igniter module comprises a transformer carrier, a slide-in electrical connector, a pc board, and a housing. Assembly of the lamp igniter module is accomplished by initially inserting a transformer carrier assembly within the housing and subsequently installing a slide-in electrical connector which may or may not be attached to the pc board.

9 Claims, 14 Drawing Sheets

SECTION A-A

SECTION A-A

LAMP IGNITER MODULE AND TRANSFORMER CARRIER

BACKGROUND OF THE INVENTION

This disclosure relates to a high voltage igniter module used to ignite a lamp, for example a HID (High Intensity Discharge) lamp as used in an automotive headlamp assembly. Specifically, the disclosed igniter module and associated transformer carrier and slide-in connector can be utilized within a D1 automotive headlamp housing enclosure.

Conventionally, high voltage igniter circuits are used to start HID lamps. One example of a HID lamp requiring a high voltage ignition is an automotive lamp commonly referred to as a headlamp. To produce the high voltage ignition signal, an igniter circuit is operatively connected to the HID lamp. Conventional configurations of an automotive headlamp assembly include an igniter circuit housed within the HID lamp assembly, the igniter circuit including a lead frame and a transformer. The igniter lead frame carries electrical components to produce a high voltage ignition signal. In addition, the lead frame may provide electrical connection points to power the ignition circuit and deliver the high voltage ignition signal to a HID lamp. For purposes of this disclosure, high voltage refers to voltages in the approximate range of 1 kv-30 kv and low voltage refers to voltages less than 1 kv.

One example of a conventional embodiment of a high voltage igniter circuit includes a housing configuration which conforms to the D1 industry standard for igniter modules. Among other requirements, the D1 standard specifies overall dimension and weight limitations attributed to an igniter module assembly for use in particular automobiles.

U.S. Patent Application Publication 2004/0066150 discloses a gas discharge lamp base comprising an ignition device. The housing includes a compartment within the housing to contain a high voltage ignition transformer which is mounted to a lead frame. The igniter module is connected to an AC source such as a ballast via a connector either molded directly to the housing or attached to the lead frame prior to assembly of the lead frame within the housing.

This disclosure provides an igniter module and associated transformer carrier and slide-in connecter arrangement and method of assembly.

BRIEF DESCRIPTION OF THE INVENTION

A lamp module comprises a housing comprising a lamp receiving area; a transformer assembly comprising a transformer and a carrier comprising a first face and a second face, wherein the transformer is mounted to the first face, the first face is substantially isolated from the second face, one or more transformer leads extend from the first face to the second face and the transformer assembly is mounted in the housing in a predetermined position in relation to the lamp receiving area. The carrier first face is positioned closest to the lamp receiving area relative to the position of the carrier second face, and a pc board is mounted in the housing, the pc board comprising connection points corresponding to each of the one or more transformer leads extending from the first face to the second face.

The lamp module includes a housing comprising a lamp receiving area; a transformer assembly comprising a carrier, a transformer mounted to the carrier, and transformer electrical connection conductors extending from the carrier, said transformer assembly mounted in the housing in a predetermined position in relation to the lamp receiving area; a slide-in electrical connector comprising a plurality of electrical; conductors extending from the connector, said connector mounted in a cutout in a housing wall; and a pc board mounted in the housing and having connection points corresponding to each of the transformer electrical connection conductors and the plurality of electrical conductors such that the pc board connection points mate with the transformer electrical connection conductors and the slide-in electrical connector electrical conductors as the pc board is mounted in the housing.

A method of assembling a lamp module transformer carrier having a first and second face, and a potted transformer located on the first face, the potted transformer comprising primary and secondary windings; a pc board comprising a first face, a second face and a slide-in electrical connector, the first face comprising low voltage electrical components; and a housing comprising a lamp insertion area located on a first face of the housing. The method comprises fastening the transformer carrier within the housing, the transformer carrier orientated with the transformer carrier first face positioned nearest to the housing first face; and fastening the pc board within the housing, the pc board first face positioned nearest to the transformer carrier second face and the slide-in connector sliding in a housing face cutout.

DETAILED DESCRIPTION OF THE INVENTION

This disclosure provides an igniter module and associated transformer carrier for use in igniting a lamp with a high voltage, for example a HID lamp. An igniter module circuit is embodied with a pc board carrying low voltage electronic components and a potted transformer is substantially encapsulated on a transformer carrier. The igniter module assembly process includes the initial insertion of a transformer carrier comprising a potted transformer into the igniter module housing. Subsequently, a connector, pc board and bottom cover are installed to complete the assembly.

Figure 1:
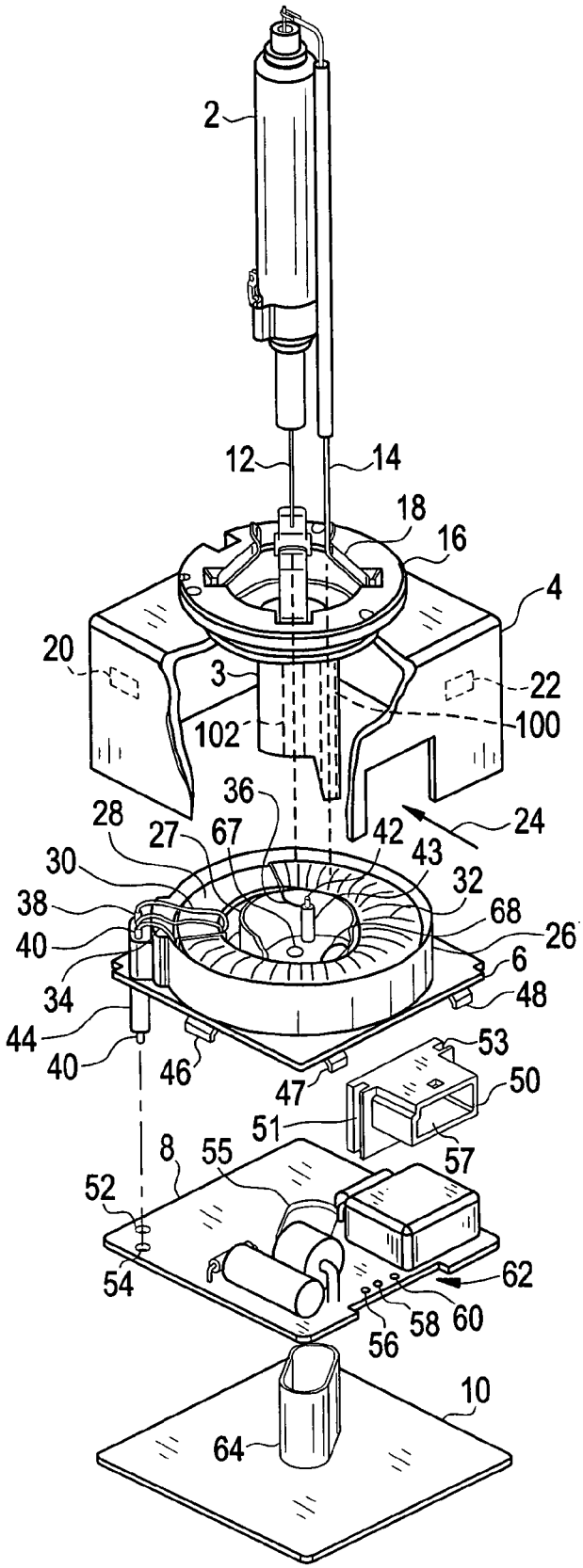
FIG. 1 is an exploded isometric view of a lamp igniter module, the figure includes a cutaway view of the housing and the transformer carrier.
Figure 2:
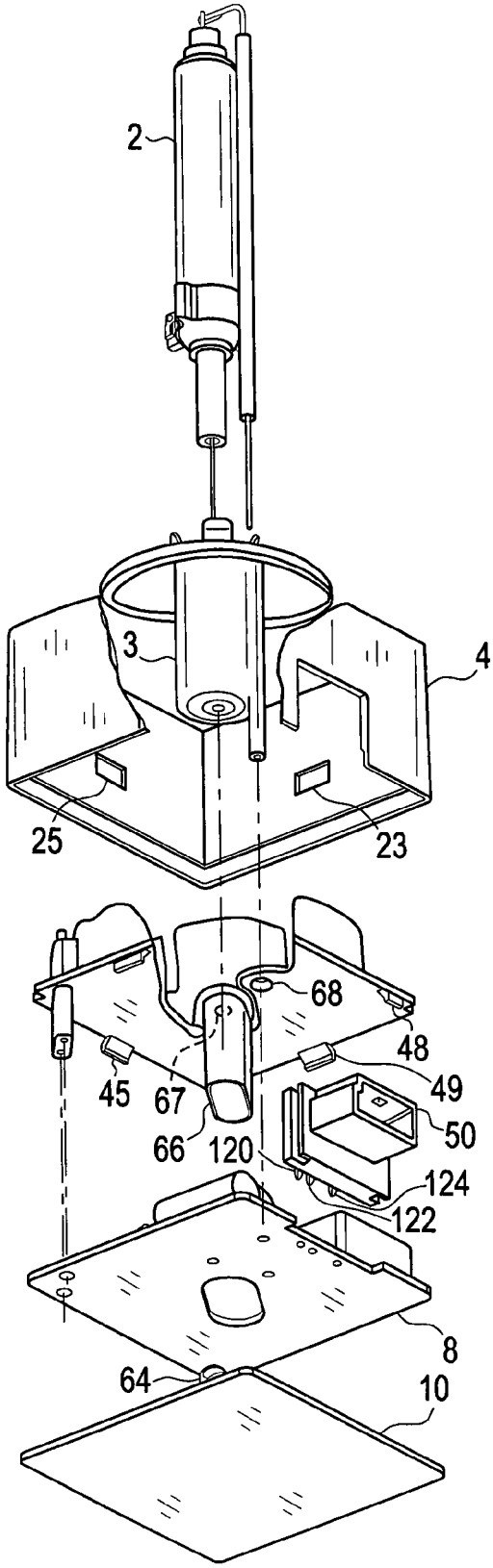
FIG. 2 is another exploded isometric view of the lamp igniter module illustrated in FIG. 1, the figure includes a cutaway view of the housing and the transformer carrier.

With reference to FIGS. 1 and 2, the lamp igniter module comprises a lamp 2 mounted to a housing 4 that contains a transformer assembly carrier 6. A slide-in electrical connector 50 is connected to the housing and is electrically connected to a pc board 8. A housing bottom cover 10 is received over a base portion of the housing to enclose the various components.

The transformer carrier assembly 6 includes a transformer carrier x formed to fit within the housing 4. The carrier x has a plurality of engagement tabs 45-49 extending from the sides of the carrier to mate with engagement slots 20-25 when the carrier assembly is mounted in the housing. The carrier further includes concentric rings or walls 26, 27 extending perpendicular to the upper surface of the carrier. The walls define a space within which the transformer T is mounted. The inner concentric wall 27 also forms an isolation cavity IC which will be described more fully below. Within the isolation cavity, through the carrier 6, are located openings 67, 68 through which lamp leads 12, 14 are inserted during assembly.

The carrier 6 also includes a lead guide 44 for housing and directing a pair of electrical conductors 38, 40 from the upper side of the carrier through to the lower side of the carrier as illustrated in FIGS. 1 and 2.

A toroidal transformer T is comprised of a core 28, primary winding 30 and secondary winding 32. The details of the construction of one such transformer can be found in co-pending application serial number [to be assigned] which is incorporated herein by reference. The transformer T is mounted to the carrier within the space formed by concentric walls 26, 27.

The transformer core 28, primary winding 30 and secondary winding 32 are substantially encapsulated or potted within the confines of the space defined by walls 26, 27. The transformer core 28 illustrated is a toroid shaped core, however other conformations such as a "c" shaped core and combination "c" and bar core can be used to construct a transformer utilizing the transformer carrier disclosed in FIG. 1 and throughout this disclosure. To accommodate other shaped transformers, the transformer tray 26 is adapted or configured according to the shape of the transformer.

With regard to the routing and electrical terminations of the primary winding 30 and secondary winding 32, a first lead of the primary winding 30 is electrically connected to electrical conductor 40 within lead guide 44, and a second lead of the primary winding 30 is electrically connected to electrical conductor 38 within lead guide 44. A first lead of the secondary winding 34 is electrically connected to an electrical conductor 40 within lead guide 44, and a second lead 36 of the secondary winding 32 is electrically connected to electrical conductor 42 within lead guide 43. Electrical conductor 40 provides a common connection point for the primary 30 and secondary windings 32.

Figure 3:
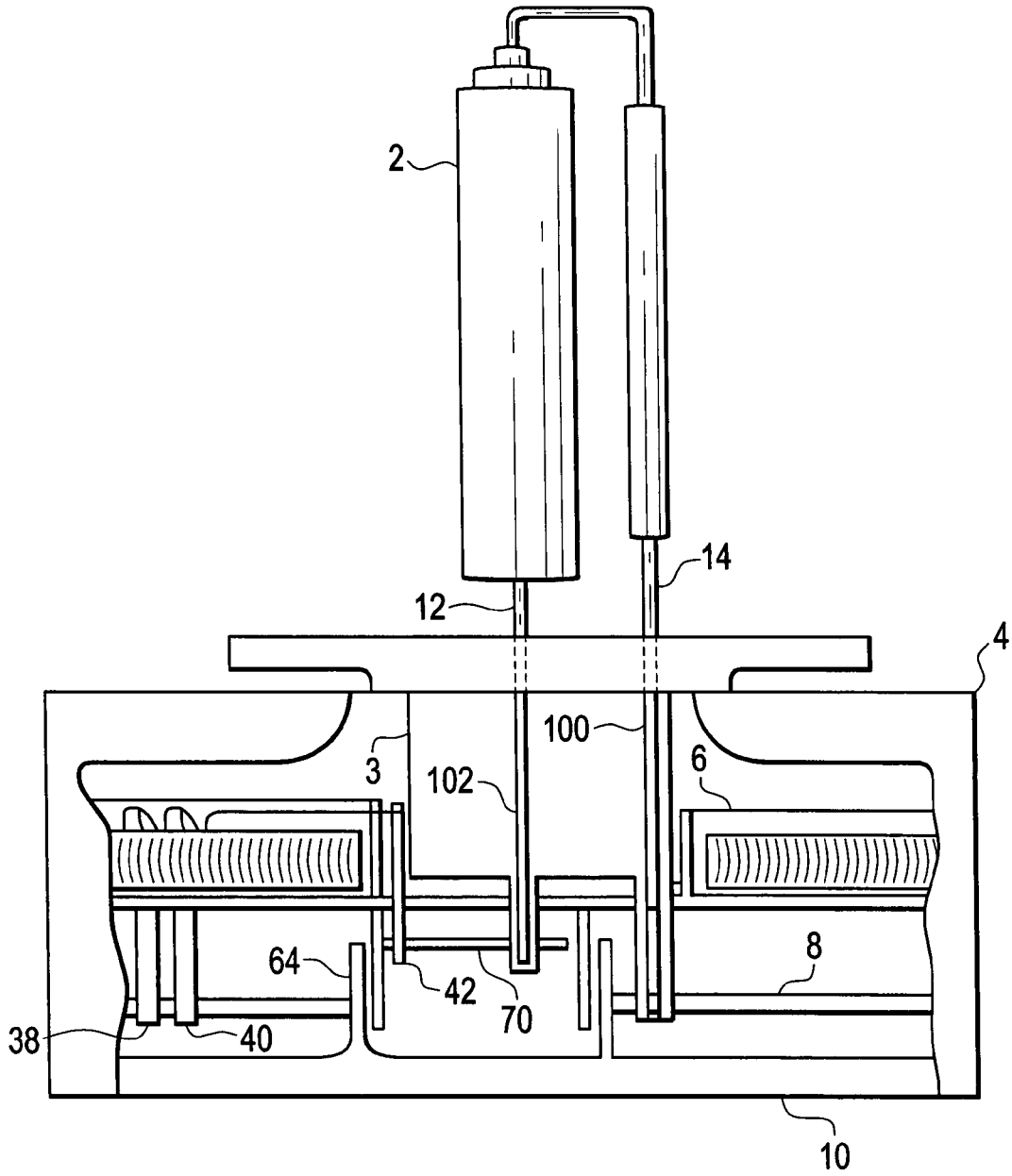
FIG. 3 is a cutaway view of the lamp igniter module illustrated in FIGS. 1 and 2.

Additional features of the transformer carrier 6 include an isolation cavity IC defined by wall 27 operatively connected to a lead encasement base 66 illustrated in FIG. 2. As shown, lead guides within lamp lead encasement 3 position and route lamp leads 12, 14 through lead guide openings 67, 68, respectively. Lead guide openings 67, 68 position and route lamp leads 12 and 14 through the carrier 6 where the lamp lead 12 is routed into lead encasement base 66 for electrical connection of lamp lead 12 to electrical conductor 42. Electrical conductor 42 is positioned and routed within lead guide 43 to the lead encasement base 66 as illustrated in FIG. 3.

With continuing reference to FIGS. 1 and 2, a slide-in connector 50 comprises electrical conductors 120, 122, 124, and channel raceways 51 and 53 preferably provided on sidewall portions of the connector. Housing 4 includes a cutout area 24 within which slide-in connector is mounted. The channel raceways engage the housing in the area of the cutout and hold the connector in place after assembly. Notably, the carrier 6 is mounted in the housing 4 prior to installation of the slide-in connector 50 which may or may not be mounted to the pc board 8 prior to being mounted in the housing cutout area 24 by way of sliding the channel raceways 51, 53 along the exposed edges of the housing cutout area 24. External electrical connections to the igniter module are provided at connection port 50 that includes electrical conductors 120, 122, 124.

With regard to pc board 8, the pc board includes lead guide openings 52, 54 which position carrier electrical conductors 38, 40, respectively, within the pc board for subsequent electrical connections to pads, tracks or other means for electrical connection operatively connected to the pc board 8. Lead guide openings 56, 58, 60 provide electrical positioning and routing of electrical conductors 120, 122, 124, respectively, to pc board electrical connection points. A pc board clearance opening 55 provides clearance and positioning of the lead encasement base 66 associated with the carrier 6, where the lead encasement base 66 extends through the pc board as illustrated in FIG. 3. PC board edge cutout area 62 provides clearance for the mounting of the slide-in connector 50 to the pc board 8.

The housing cover 10 comprises a lead encasement base cover 64 which is similarly shaped and which substantially encloses the lead encasement base 66. This arrangement electrically isolates lamp lead 12 and transformer secondary winding connection post/conductor 42 from the pc board 8 and its associated electrical components.

FIG. 3 illustrates the housing 4, the housing lamp lead encasement 3, the transformer carrier 6, the pc board 8 and the lead encasement cover 64 associated with the bottom cover 10 in assembled relation. The integration of these members, as disclosed, locates various components at predetermined positions relative to one another. Moreover, the disclosed arrangement provides a relatively simple module assembly process, including soldering and/or welding of the lamp leads, transformer winding leads and conductors associated with the connector. Furthermore, the lamp module illustrated in FIGS. 1-3 provides electrical isolation of relatively high voltage leads and connections from other electrical component connections and leads associated with a relatively low voltage.

FIG. 3 further illustrates positioning of the transformer carrier 6 relative to the housing. Notably, lamp leads 12, 14 extend through the carrier 6, where the lead encasement lead guide 100 also extends through the pc board 8 to provide desired electrical isolation. The lamp lead encasement 3 and transformer carrier 6 are substantially composed of an insulating type material, for example plastic, which electrically insulates lamp leads 12, 14 from the surrounding area.

With regard to further positioning of the lamp module members relative to each other, carrier electrical conductors 38, 40 are matingly aligned to be received by pc board guide openings 52, 54, respectively. In addition, pc board clearance opening 55 provides additional alignment of the pc board relative to the transformer carrier 6 by means of the lead encasement base 66.

The electrical conductor 42 is electrically connected to secondary winding lead 36 as illustrated in FIG. 3, positioned in the carrier isolation cavity, and extends through the carrier 6 into the lamp lead encasement base 66. Notably, the conductor 42 and associated lead guide 43 are located between the wall of the isolation cavity and the mated lamp lead encasement 3. This arrangement eliminates interference between the secondary winding lead 36 connection to electrical conductor 42 and the lamp lead encasement 3. In addition, the vertical offset relationship of the lamp lead encasement 3 and the carrier lead encasement base 66 provides for electrical isolation of electrical conductor 42. Electrical connection of electrical conductor 42 to lamp lead 12 in the lamp lead encasement base is provided by means of connection plate 70.

The bottom cover 10 and associated lead encasement cover 64 fit on the outside of the walls of the lead encasement base 66. Notably, this provides for a relatively longer creepage distance from the lamp lead connection to the pc board 8, as compared to an arrangement where the lead encasement cover 64 is fitted on the inside walls of the lead encasement base 66. Further, the lead encasement cover 64 is composed substantially of an electrical insulating material.

Figure 4B:
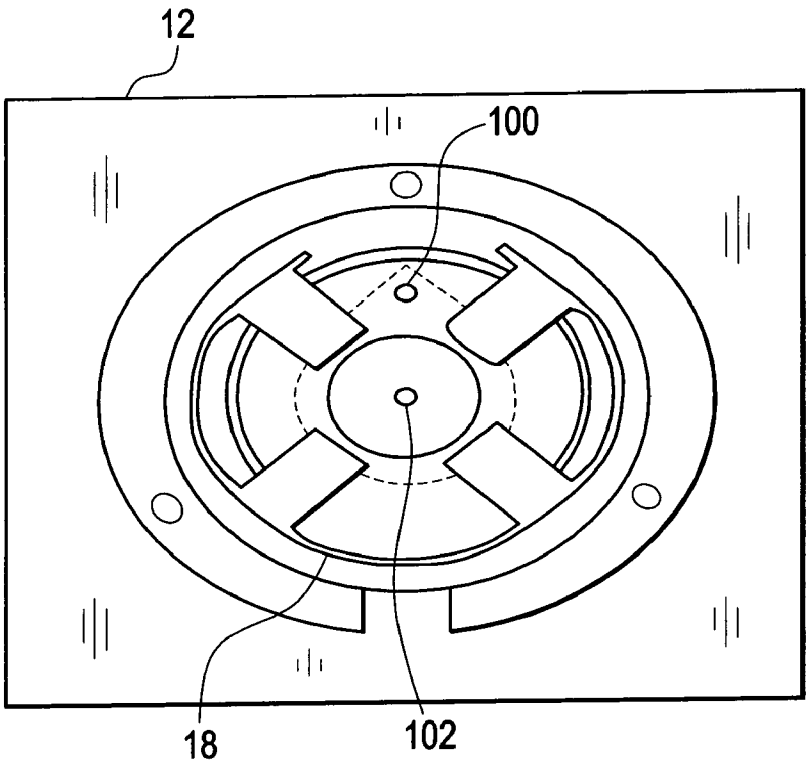
FIGS. 4A and 4B illustrate a lamp igniter module housing.
Figure 4A:
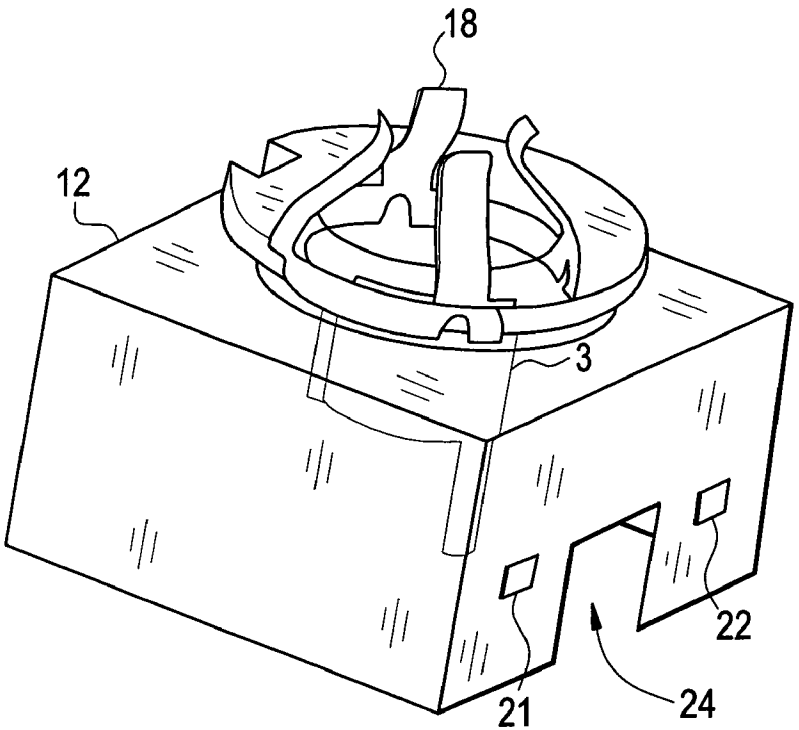

With reference to FIG. 4A and FIG. 4B, illustrated are detailed views of an igniter module housing according to an exemplary embodiment of this disclosure. The igniter module housing 12 comprises a metal crown 18 (FIGS. 4A-4B) to support an attached lamp. Within the center area of the crown mount 18 are lamp lead guide openings 100, 102 through which the lamp leads are fed. In addition to the housing face cutout 24 for installation of a slide-in electrical connector 50 as illustrated in FIGS. 1 and 2, tab engagement slots 21, 22 are more prominently illustrated. The tab engagement slots are located on one or more faces of the housing and are used to position and attach a transformer carrier (FIGS. 5A, 5B) within the housing at a predetermined position.

Figure 5A:
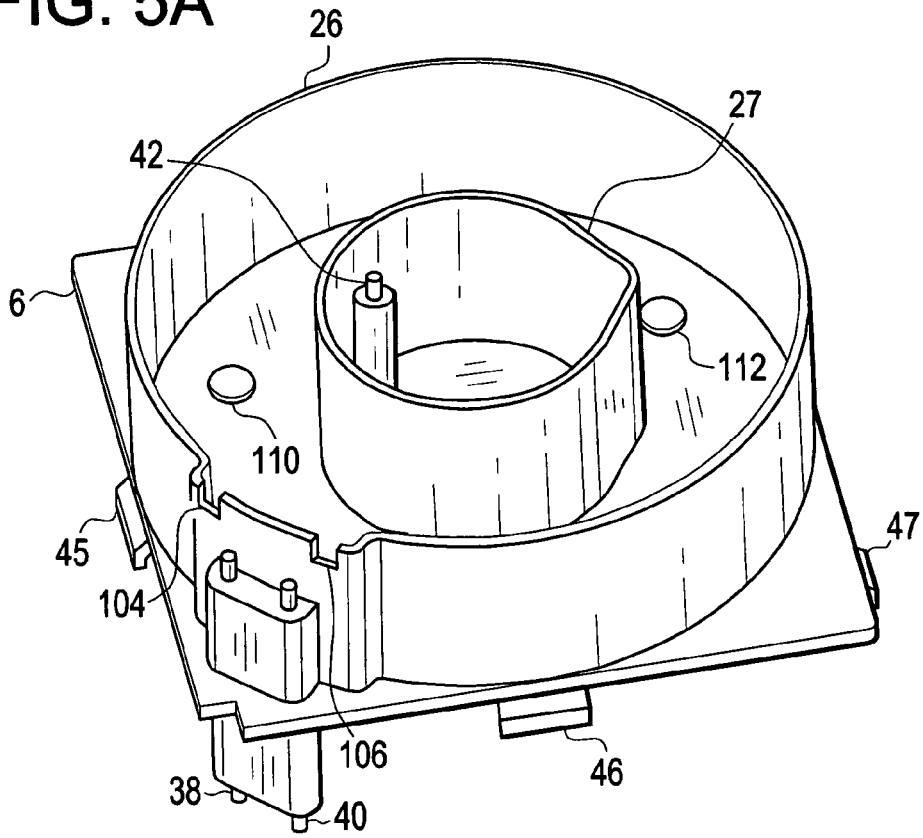
FIGS. 5A and 5B illustrate a transformer carrier.
Figure 5B:
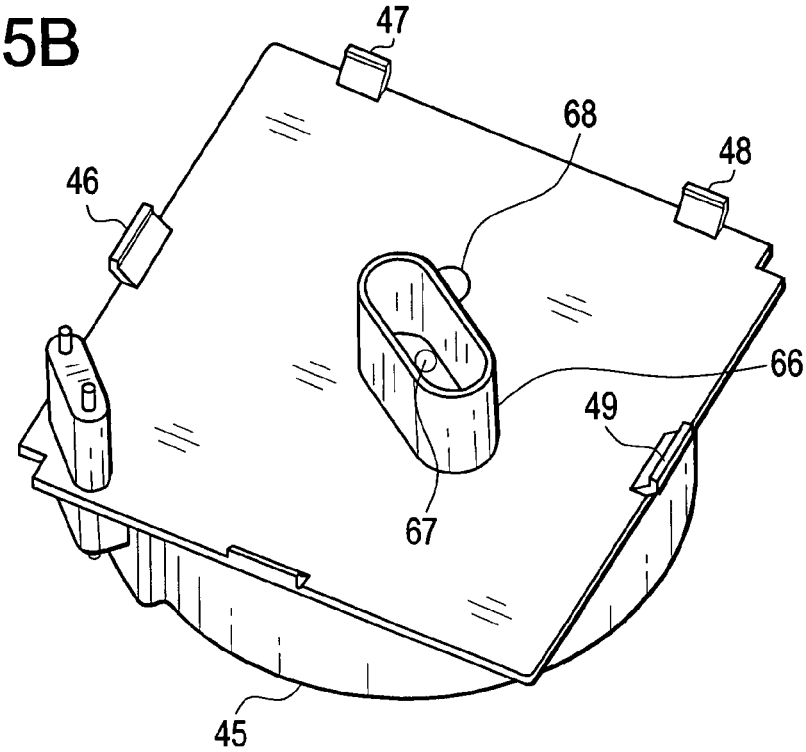

FIGS. 5A and 5B illustrate two of three standoffs or support buttons 110, 112 which support a wound transformer core 28 and provide clearance between the transformer tray 26 bottom and the wound transformer core 28 for potting material. Notably, other means or support configurations for providing a space between a wound transformer core 28 and the transformer tray 26 bottom are within the scope of this disclosure. FIG. 5A also illustrates tray openings 104 and 106 which provide a means or passages for routing transformer winding leads to electrical conductors 38 and 40. FIG. 5B, on the other hand, shows how tabs 45, 46, 47, 48, 49 fasten the transformer carrier to the igniter module housing, and lead guide opening is provided with lead encasement 68 for a current return lead of a lamp. This isolates the lamp high voltage lead and secondary winding high voltage lead.

Figure 6A:
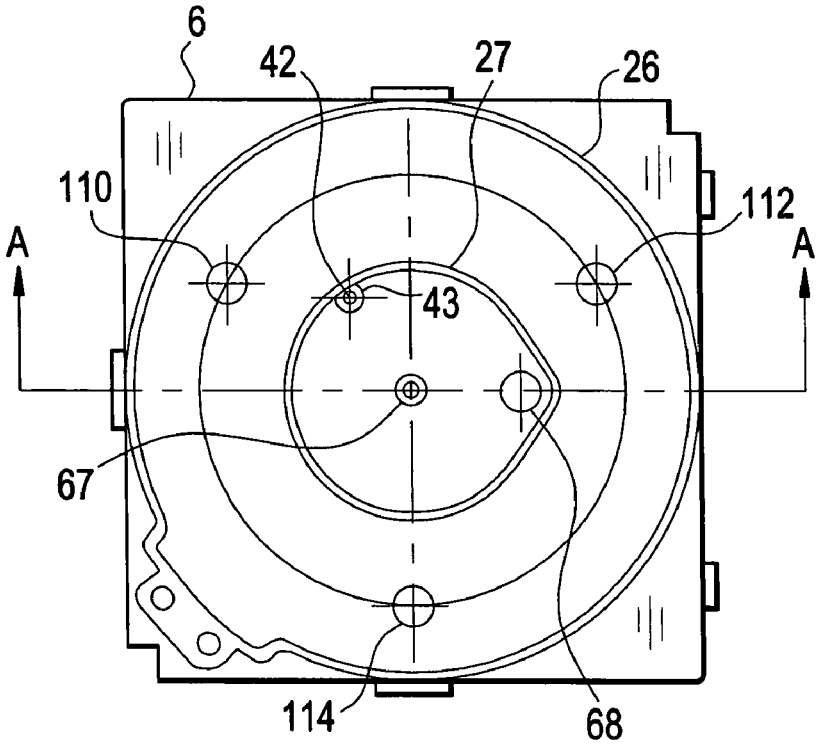
FIGS. 6A through 6D illustrate a transformer carrier.
Figure 6B:
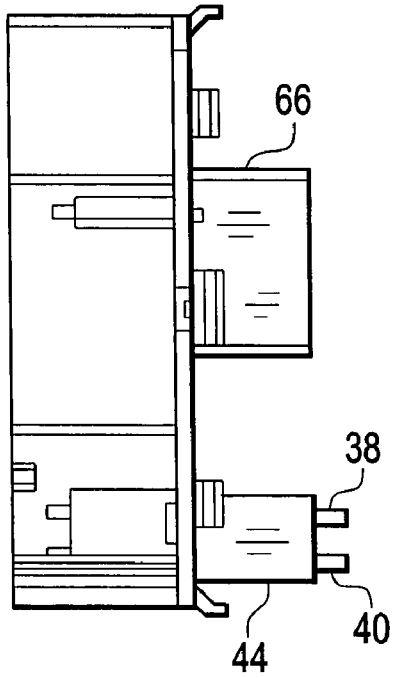
Figure 6C:
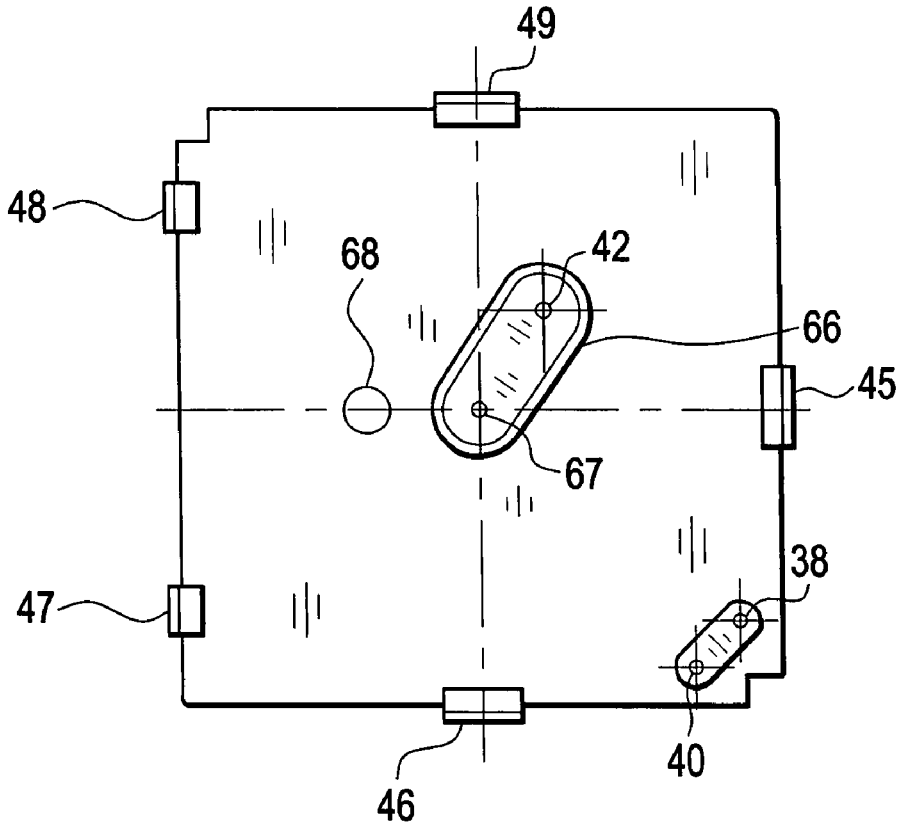
Figure 6D:
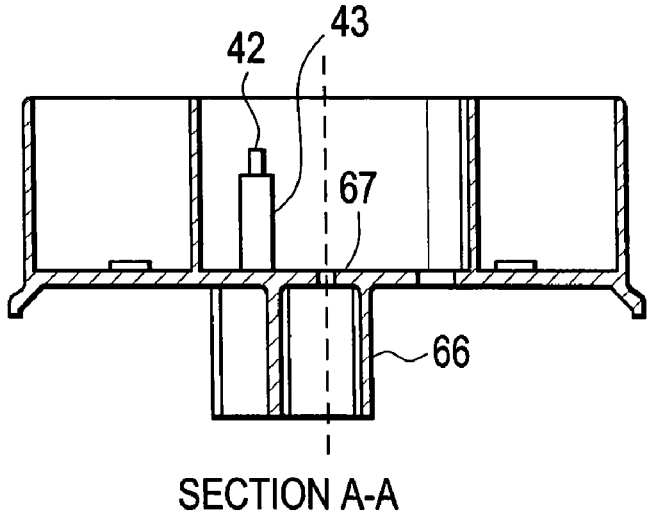

FIGS. 6A and 6C further illustrate the spatial relationship of electrical conductor 42/lead guide opening 43 relative to lead guide opening 68 and lead guide opening 67. Similarly, FIG. 6B illustrates the spatial relationship of lead encasement base 66 and lead guide encasement 44 which includes electrical conductors 38 and 40.

Figure 7B:
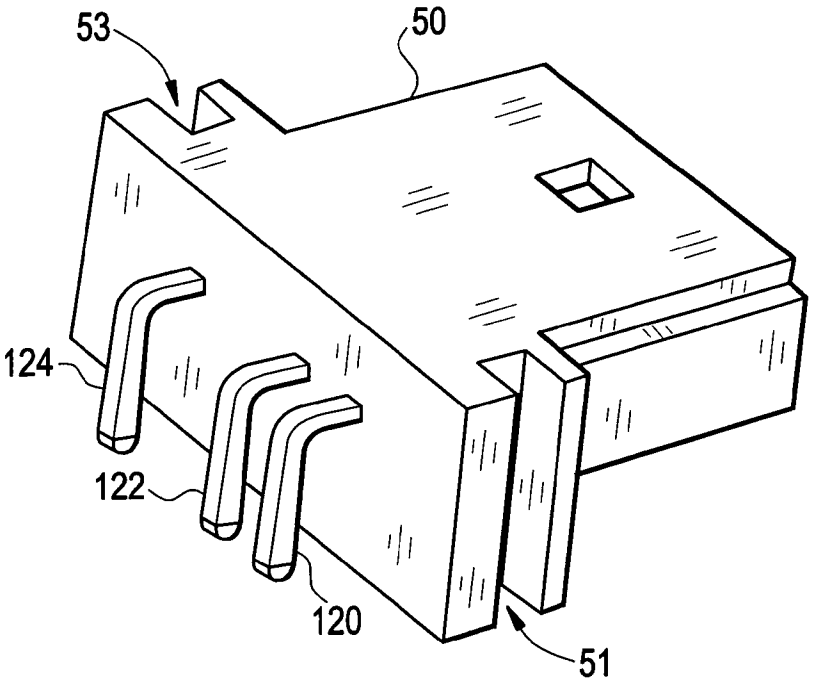
FIGS. 7A and 7B illustrate a slide-in connector.
Figure 7A:
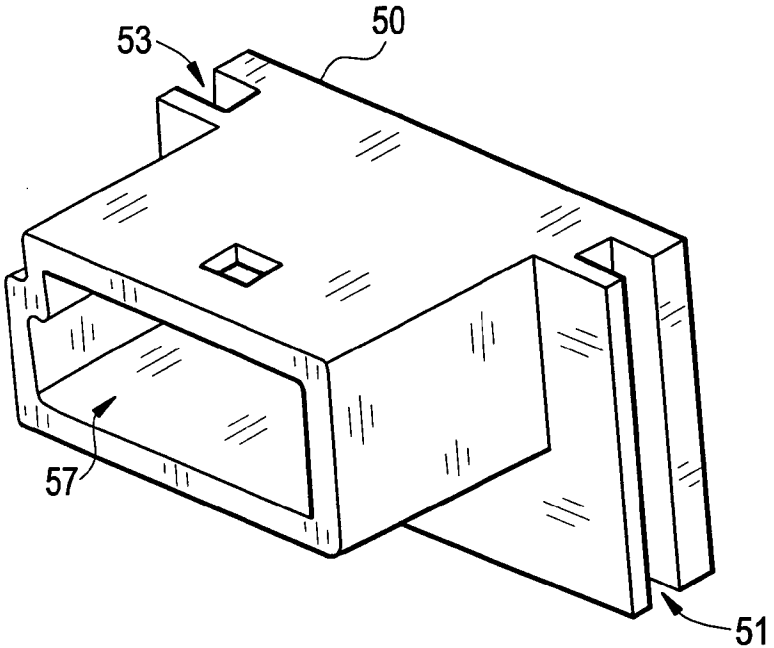
Figure 8A:
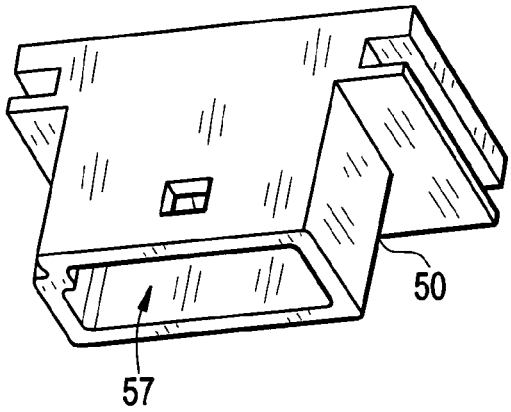
FIGS. 8A through 8E illustrate a slide-in connector.
Figure 8B:
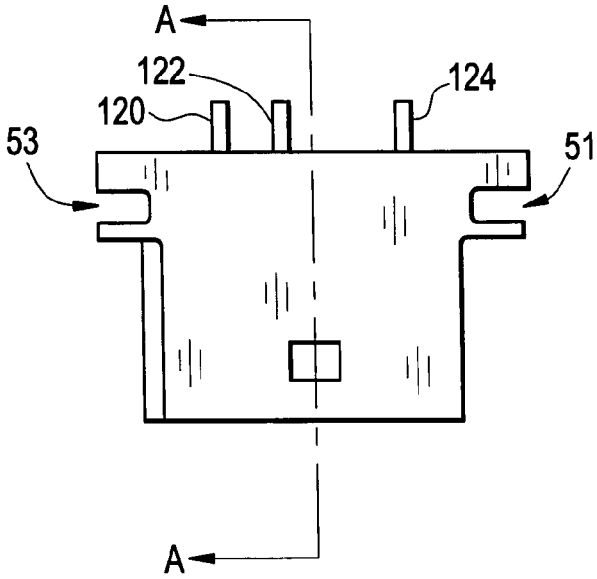
Figure 8C:
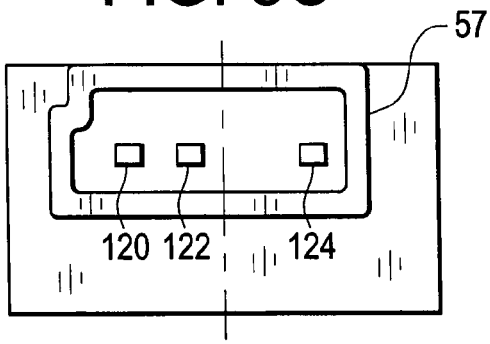
Figure 8D:
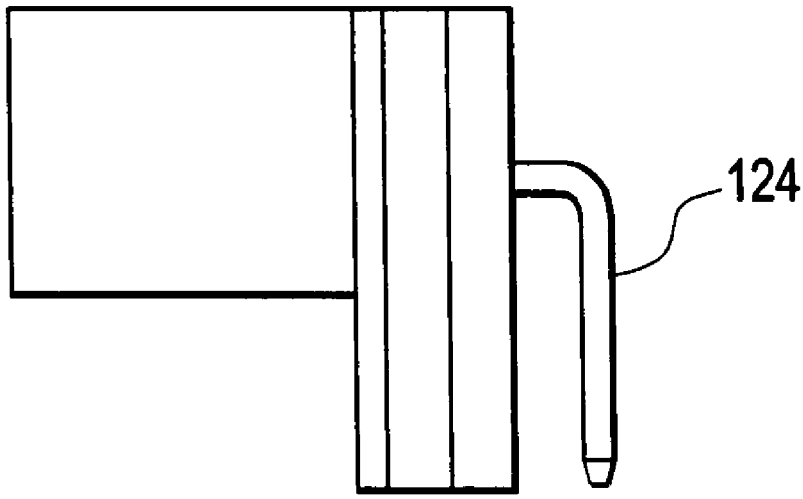
Figure 8E:
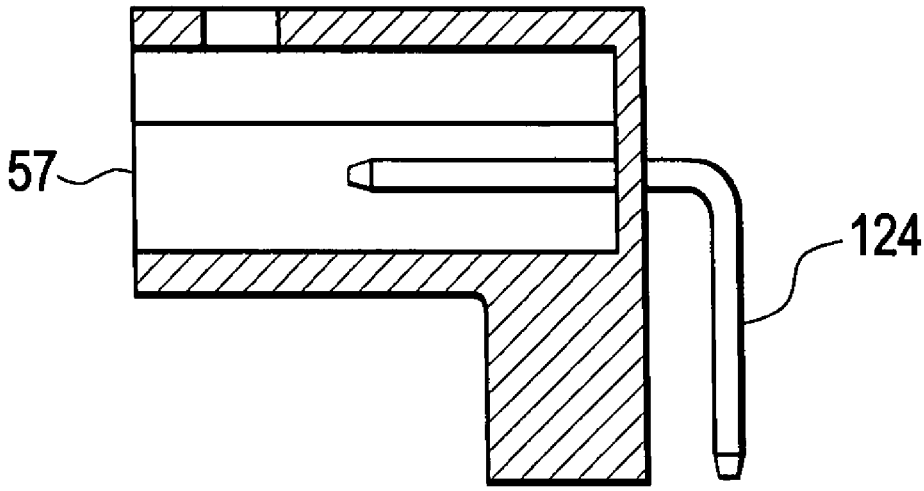

The enlarged, detail views of FIGS. 7A and 7B more particularly illustrate the channels 51, 52 and the location of the first, second and third electrical conductors 120, 122, 124. In addition, the relationship between the electrical connection port 57 and the conductors 120, 122, 124 is evident for mating with an associated external connector (not shown). Further details of this relationship are shown in FIGS. 8A-8E.

Figure 9A:
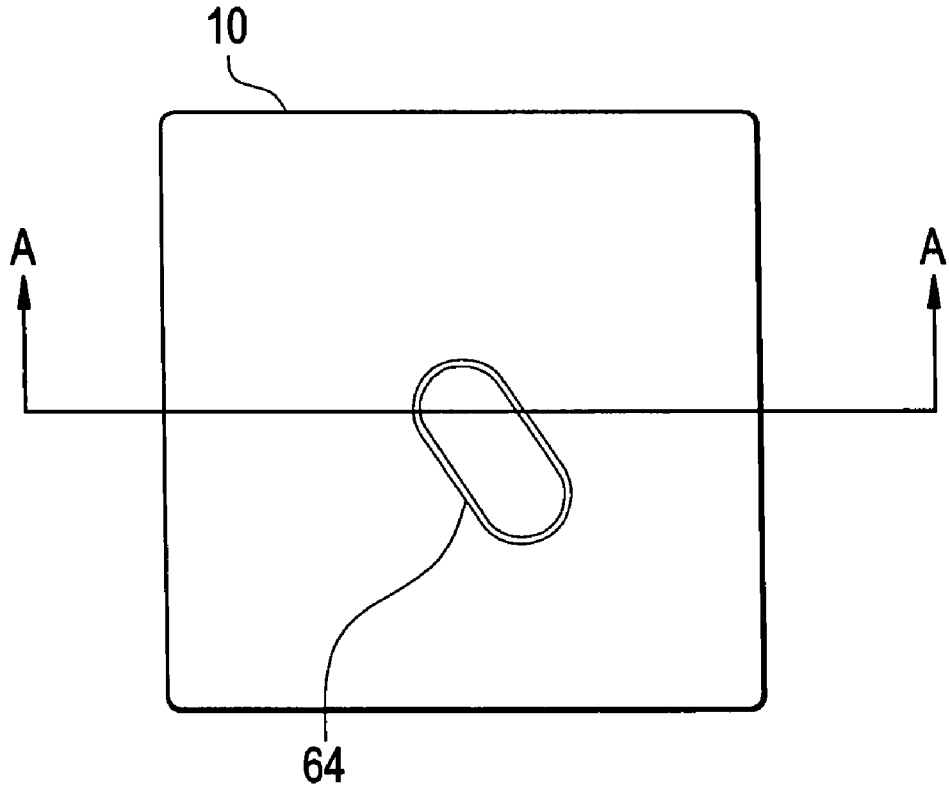
FIGS. 9A and 9B illustrate a top view and side view, respectively, of a housing cover.
Figure 9B:
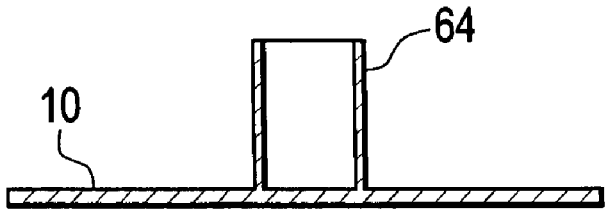

As briefly discussed above, the positioning of the lead encasement base cover 64 on the outside of the transformer carrier lead encasement 66 (FIGS. 9A-9B) provides a greater creepage distance between the high voltage connection/leads and the low voltage circuitry, as compared to the positioning of the lead encasement base cover 64 on the inside of the transformer carrier lead encasement base 66.

Figure 10B:
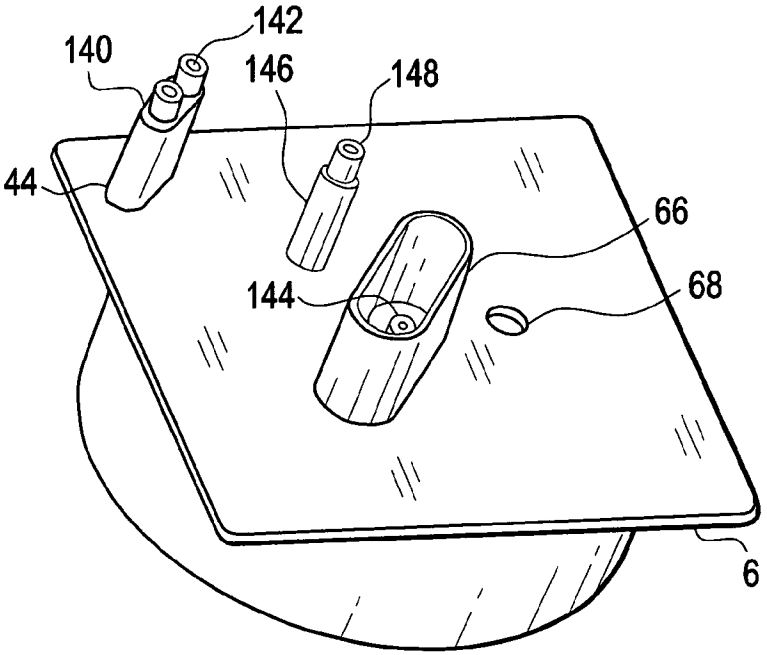
FIGS. 10A and 10B illustrate a transformer carrier.
Figure 10A:
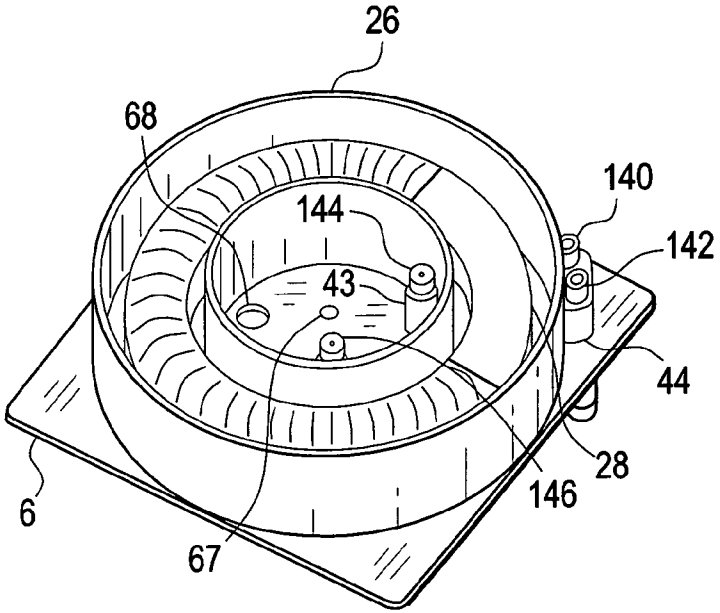

The transformer carrier embodiment of FIGS. 10A-10B includes an additional lead guide 43 which routes a low voltage lead of the secondary winding. This arrangement requires the primary and secondary winding common electrical connection be made external to the transformer carrier, for example at the pc board wherein the pc board receives electrical conductors within lead guides 140, 142 and/or 148. Another feature illustrated in FIGS. 10A and 10B is the use of lead guide sleeves 140, 142, 144 and 148 which extend through lead guide supports 44, 43 and 146. Notably, the sleeves are composed substantially of an isolating material, for example plastic or ceramic.

Igniter module assembly process steps according to one exemplary embodiment are demonstrated I FIGS. 11A-11E. The assembly process includes five stages, for example. During stage one 160 (FIG. 11A), the transformer carrier 6 is inserted within the housing 4 and attached to the inner walls of the housing, for example, by glue, ultrasonic welding, tabs, etc. As illustrated in stage two 170 (FIG. 11B), after attachment of the transformer carrier 6 to the housing 4, the slide-in electrical connector 50 is attached to the cutout area 24. This connector mounting arrangement provides additional support for the connector 50 and associated terminals (not shown), as well as resisting pull-out forces. Further attachment of the slide-in electrical connector 50 can be accomplished by gluing, ultrasonic welding, pressed fit, etc.

Figure 11C:
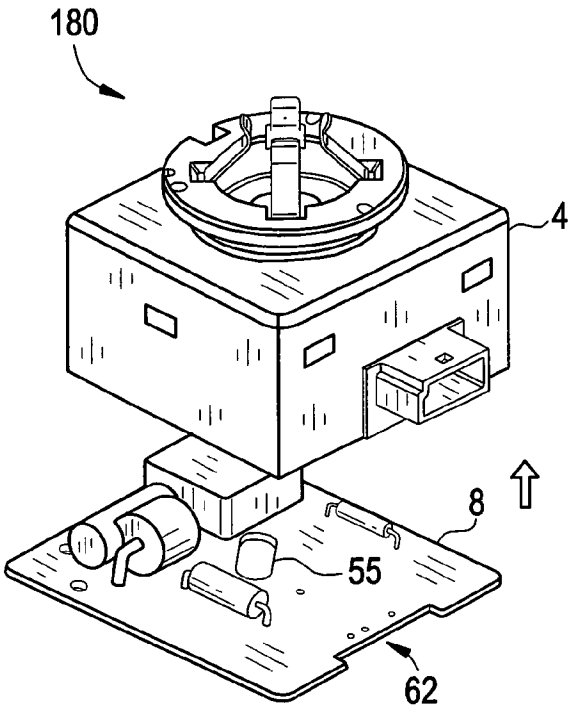
FIGS. 11A through 11E illustrate the assembly steps and components of a lamp igniter module.
Figure 11B:
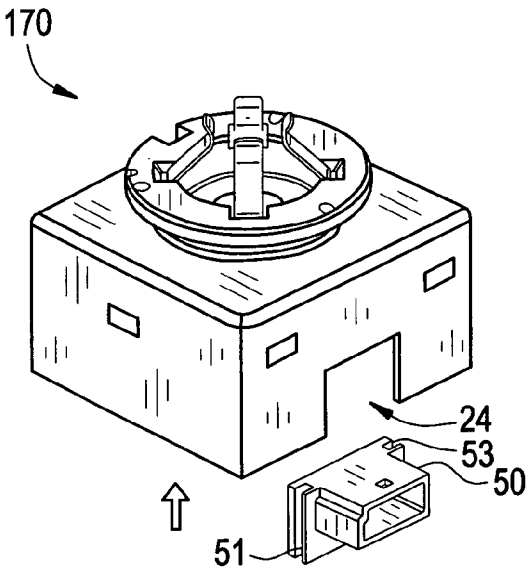
Figure 11A:
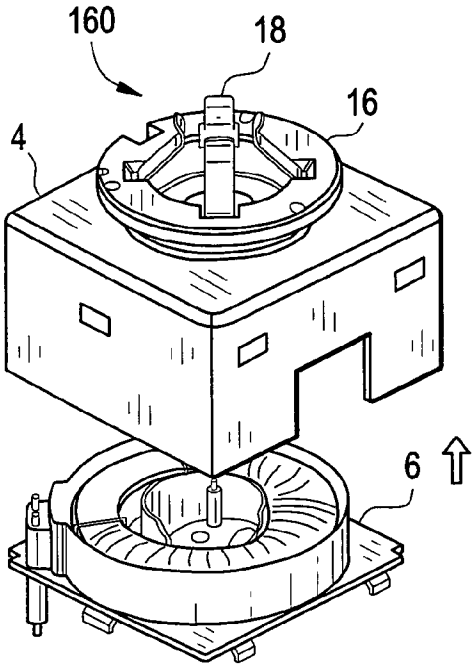
Figure 11E:
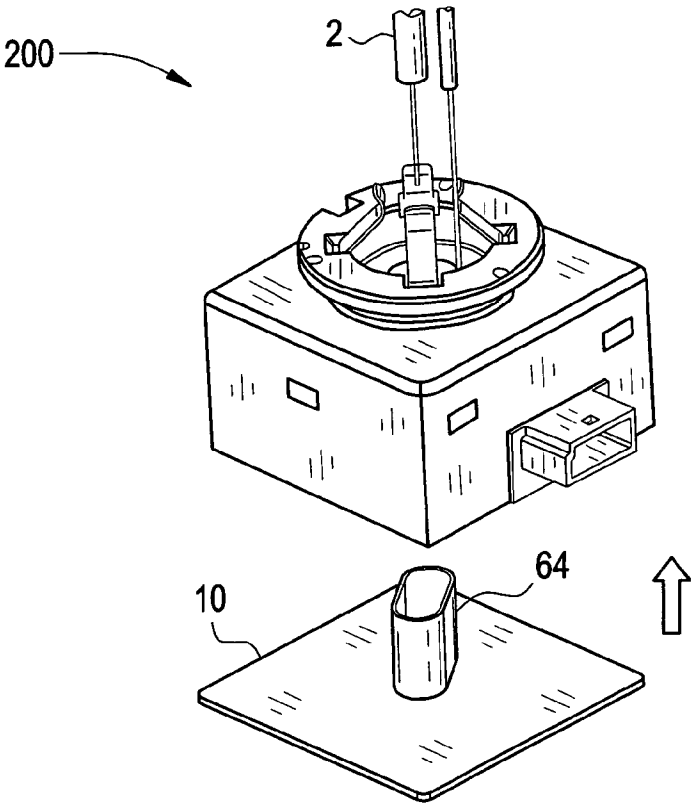

In FIG. 11C, a third step 180 in the assembly process includes inserting the pc board 8 and associated edge cutout area 62 into the housing 4. The edge cutout area 62 of the pc board provides pc board clearance of the electrical slide-in connector 50 and may provide additional support to the connector 50 from inside the housing 12. Notably, the conductors provided on the slide-in connector 50 are aligned with their respective pc board 8 lead guide openings, the transformer carrier 6 lead guides/electrical conductors are aligned with their respective lead guide openings, and the carrier lead encasement base 66 is extended through the pc board clearance opening 55.

Figure 11D:
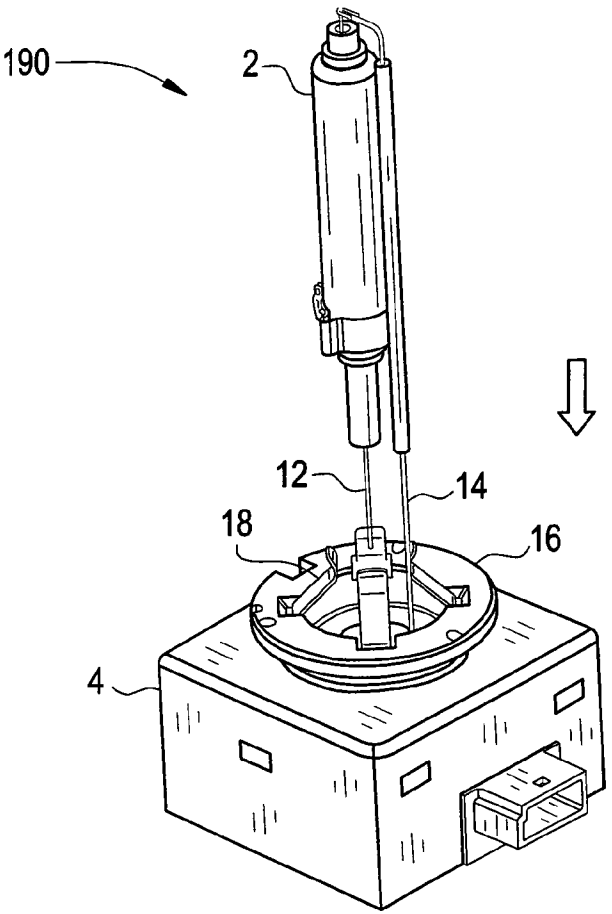

A fourth step 190 is shown in FIG. 11D where the lamp is inserted into the lamp insertion area 16 of the housing 4. During this stage, it is important that a first lead 12 and a second lead 14 of the lamp are inserted through independent lead guide openings within the lamp insertion area 16 of the housing 4. The lamp is subsequently welded to the crown 18 fingers.

As a final step 200 of the assembly process, electrical connections for a lamp 2, slide-in connector 50, pc board 8 and transformer carrier assembly 6 are completed. These electrical connections are completed by accessing the relevant connection points from the underside of the housing 4 prior to the housing bottom cover 10 being attached. The housing bottom cover 10 is attached to the housing 4, and particularly encasement cover 64 electrically seals the high voltage direct connection point associated with the secondary winding and lamp 2. Further attachment of the bottom cover 10 is accomplished, for example, by gluing, ultrasonic welding or other attachment means.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp module comprising:

a housing comprising a lamp receiving area;

a transformer assembly comprising a transformer and a carrier comprising a first face and a second face, wherein the transformer is mounted to the first face and surrounded about inner and outer surfaces by conforming carrier walls that extend perpendicular to the first face, the first face is substantially isolated from the second face, one or more transformer leads extend from the first face to the second face and the transformer assembly is mounted in the housing in a predetermined position in relation to the lamp receiving area, where the carrier first face is positioned closest to the lamp receiving area relative to the position of the carrier second face, lead guides for routing a first lamp lead to the carrier second face, a second lamp lead to the carrier second face and a transformer lead connection post extending from the first face to the second face; and a pc board mounted in the housing, the pc board comprising connection points corresponding to each of the one or more transformer leads extending from the first face to the second face.

2. The lamp transformer carrier according to claim 1, wherein the transformer is toroidal shaped to receive a toroidal bar core.

3. The lamp transformer carrier according to claim 2, further comprising:

one or more stand offs supporting the toroidal shaped transformer above the bottom of the transformer tray; and potting material substantially encapsulating the toroidal shaped bar core transformer within the transformer tray.

4. The lamp module of claim 1 further comprising:

a slide-in electrical connector comprising a plurality of electrical conductors extending from the connector, said connector mounted in a cutout area of a housing wall; and a pc board mounted in the housing and having connection points. corresponding to each of the transformer electrical connection conductors and the plurality of electrical conductors such that the pc board connection points mate with the transformer electrical connection conductors and the slide-in electrical connector electrical conductors as the pc board is mounted in the housing.

5. The lamp module according to claim 4, wherein the housing is adapted to receive the transformer carrier before receiving the slide-in connector and pc board.

6. The lamp module according to claim 4, the slide-in electrical connector further comprising:

a means for positioning the slide-in electrical connector on a face of the housing.

7. The lamp module according to claim 4, the slide-in electrical connector further comprising:

a means for providing electrical continuity from the pc board to one or more electrical terminals associated with the slide-in electrical connector.

8. The lamp module according to claim 4, the slide-in electrical connector further comprising:

one or more raceways for positioning the slide-in electrical connecter on a face of the housing.

9. The lamp module according to claim 8, wherein the one or more electrical conductors have a substantially ninety degree elbow.

* * * * *